US006003731A

United States Patent [19]

Post et al.

[11] Patent Number: 6,003,731

[45] Date of Patent: Dec. 21, 1999

[54] DISPENSING APPARATUS FOR VISCOUS FLUIDS CONTAINED IN FLEXIBLE PACKAGES

[75] Inventors: Johannes Hermanus Nicolaas Post, Sassenheim; Michiel Jacobus Johannes Langeveld, Zoetermeer; Johannes Hendrikus Mink, Voorhout, all of Netherlands

[73] Assignee: Fluid Management, Wheeling, Ill.

[21] Appl. No.: 09/167,890

[22] Filed: Oct. 7, 1998

Related U.S. Application Data

[63] Continuation-in-part of application No. 08/888,826, Jul. 7, 1997.

[51] Int. Cl.[6] ..... B67D 5/52

[52] U.S. Cl. ..... 222/135; 222/144; 222/325

[58] Field of Search ..... 222/325, 333, 222/504, 144, 145.1, 135, 160

[56] References Cited

U.S. PATENT DOCUMENTS 5,356,041 10/1994 Hellenberg et al. ..... 222/144

5,711,458 1/1998 Langeveld et al. ..... 222/144

5,738,247 4/1998 Kuan ..... 222/144

*Primary Examiner*—Philippe Derakshani

*Attorney, Agent, or Firm*—Hill & Simpson

[57] ABSTRACT

An apparatus for dispensing viscous fluids includes a turntable that is rotatable about an axis of rotation. The apparatus is connected to a plurality of containers that contain fluid to be dispensed. The containers are mounted to the turntable in a spaced relationship about the circumference of the turntable. The turntable is also connected to a plurality of pumps, one pump associated with each container. The pumps include connectors that are releasably connected to the containers and that facilitate the removal of an empty container for replacement with a full container. The apparatus also includes an actuator that facilitates the removal of an empty container. The pumps are preferably disposed on an opposing side of the turntable from the containers. The apparatus also includes a plurality of rollers disposed at the outer circumference of the turntable for supporting the turntable in the radial and axial directions.

21 Claims, 9 Drawing Sheets

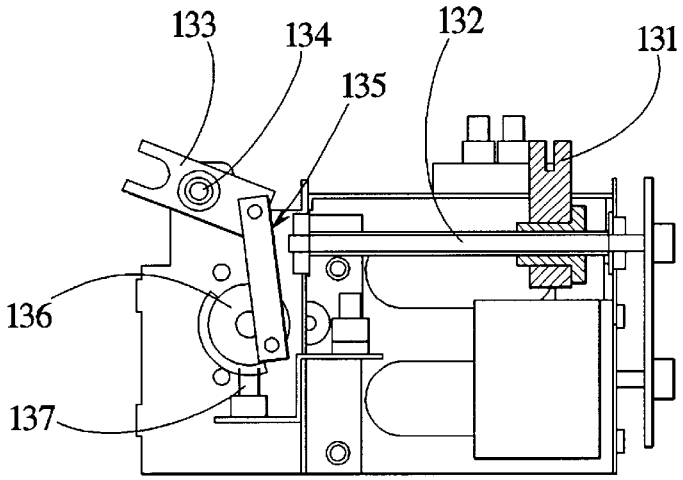
FIG. 20
FIG. 21
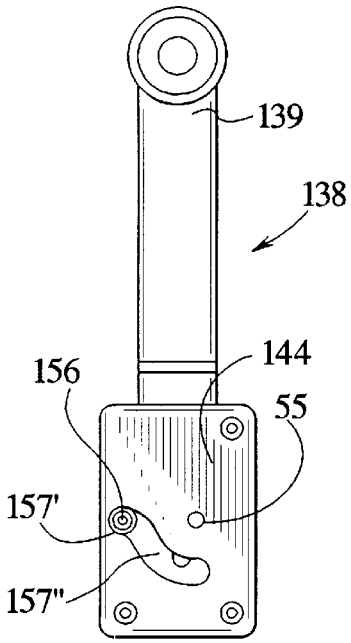
FIG. 22
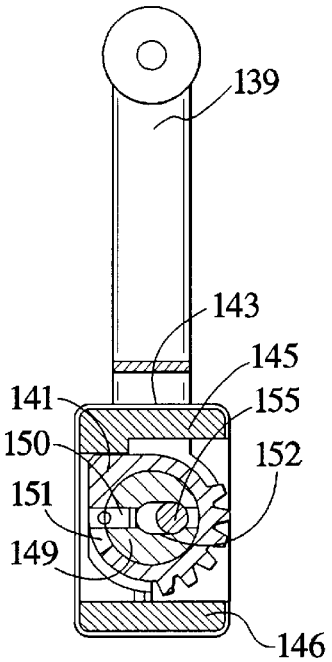
FIG. 23
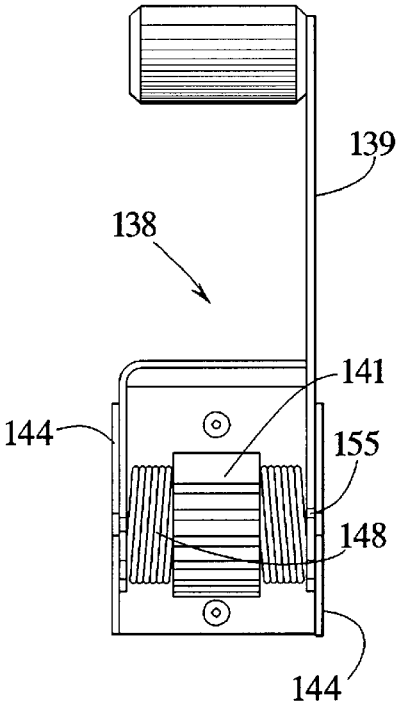

DISPENSING APPARATUS FOR VISCOUS FLUIDS CONTAINED IN FLEXIBLE PACKAGES

BACKGROUND OF THE INVENTION

This is a continuation-in-part of application Ser. No. 08/888,826, filed on Jul. 7, 1997, which is incorporated herein by reference.

FIELD OF THE INVENTION

The present invention relates to an apparatus for dispensing viscous fluids and, more particularly, to dispensing viscous fluids contained in flexible packages.

In many industries, a thick or viscous fluid is added to a mixture in small amounts. Because only a small amount of the viscous liquid is required for each final product, a container or reservoir of the viscous fluid must be designed so that the viscous fluid is not exposed to air for prolonged periods of time. Otherwise, the viscous fluid may dry making it difficult to mix with other fluids or liquids or resulting in the viscous fluid having to be reprocessed or wasted.

Another problem associated with the dispensing of viscous fluids is the tendency of the fluids to leave a residue or crust at the dispenser outlet. The residue can build up and potentially block the outlet or otherwise interfere with the discharge of fluid through the outlet.

In a number of industries, a single apparatus is utilized to dispense a large number of viscous fluids. Typical applications include the manufacture of hair dye or paint where a plurality of pigments may be used for a single product. Often, the container of these pigments is mounted on a rotating turntable that accommodates a plurality of containers that contain the fluid to be dispensed and that are disposed about the circumference of the turntable. A pump is typically associated with each container. One problem associated with this type of apparatus is the difficulty in changing an empty container while the apparatus is in use. This is particularly problematic when the operator has not been specifically trained to operate the apparatus. Accordingly, there is a need for an improved rotary table type apparatus which accommodates a plurality of containers that contain dispensing fluid which includes an improved configuration that makes it easier to change out empty containers quickly and efficiently.

Still another problem associated with the dispensing of viscous fluids is the exposure of the viscous fluid to air through the outlet. The invasion of air through the outlet can result in the build up of residue and crust inside the outlet which will interfere with the flow of fluid through the outlet and which could possibly result in blockage of the outlet.

Accordingly, there is a need for an improved dispensing apparatus for viscous fluids which minimizes the exposure of the fluid to air during the dispensing of the fluid and which maintains the outlet port in a clean condition and substantially free of residue.

SUMMARY OF THE INVENTION

The present invention provides a solution to the aforenoted needs in the form of a fluid dispenser that utilizes a flexible package as the initial reservoir of viscous fluid. The flexible package is connected to a pump by a conduit. The pump may be a piston-type pump having a cylinder and a piston. A lower end of the piston is disposed in the cylinder and an upper end of the piston detachably engages an actuator.

In operation, the actuator moves the piston upward in an intake stroke to draw fluid from the flexible package, through the conduit and into the cylinder. In a dispense stroke, the actuator pushes the piston downward which forces fluid out of the cylinder through an outlet. In the event the supply of viscous fluid in the flexible package becomes depleted, an intake stroke of the actuator will create a low pressure atmosphere within the cylinder, conduit and flexible package. As a result of the low pressure atmosphere, the piston is drawn downward and becomes disengaged from the actuator. Hence, the dispenser has an automatic shut off when the supply of viscous fluid in the flexible package is depleted.

In an embodiment, the dispenser is equipped with a buffer reservoir which is in communication with the flexible package and, preferably, disposed vertically below the flexible package so that the fluid flows downward through a portion of the conduit into the buffer reservoir under the force of gravity. During an intake stroke of the pump, fluid may be drawn from the flexible package, the buffer reservoir or both. In the event the flexible package is empty and the buffer reservoir is full or at least partially full, fluid is drawn from the buffer reservoir during an intake stroke.

In an embodiment, a valve is provided in the section of conduit extending between the flexible package and the buffer reservoir so that the flexible package may be isolated. When the valve is closed, an empty flexible package may be removed and replaced with a full flexible package, at the same time the pump is operating and withdrawing fluid from the buffer reservoir. Hence, the continuity of the dispense operation is not interrupted when an empty flexible package is replaced with a new full flexible package.

In an embodiment, the conduit comprises a T-section of conduit having a first section that extends between the flexible package and a buffer reservoir and a second section extending from the first section of conduit to the pump. In an embodiment, the valve is provided in the first section of conduit between the point where the second section of conduit is connected to the first section of conduit and the flexible package for isolating the flexible package and enabling an empty flexible package to be replaced with a full flexible package without interrupting the operation of the pump.

In an embodiment, an "active" buffer reservoir is provided along the conduit between the flexible package and the pump. In such an embodiment, the active buffer reservoir comprises a piston pump with a lower end of a piston disposed in a cylinder and an upper end of a piston disposed above the cylinder. A spring biases the piston upward and viscous fluid is disposed in the buffer cylinder below the buffer piston. In the event the flexible package becomes empty and a low pressure environment is created in the main pump cylinder, conduit, flexible package and buffer cylinder, the buffer piston will be drawn downward against the bias of the spring to supply fluid from the buffer cylinder to the main pump.

In an embodiment, a valve is disposed in the conduit between the buffer reservoir and the flexible package so that the flexible package can be isolated during operation of the main pump which enables an empty flexible package to be removed and replaced with a full flexible package without interrupting operation of the main pump.

In an embodiment, a plurality of dispensers made in accordance with the present invention as set forth above are disposed on a rotary table along an outer periphery of the table. Depending on the location of the pumps and outlets, a receiving station is disposed below the table along the periphery of the table or along an inside portion of the table for receiving fluid dispensed from one of the dispensers. The table can then be rotated to position any one of the dispensers mounted to the table above the receiving vessel.

In an embodiment, the outlets of the dispensers of the present invention include a scraper device that is pivotally connected to the outlet and which scrapes the outlet at the opening through which the fluid passes thereby removing film and residue that accumulates on the outlet opening after viscous fluid is passed therethrough.

In an embodiment, the outlets of the dispensers of the present invention further include a closure that is pivotally attached to the outlet which includes a main body for sealingly engaging the hole in the outlet through which the fluid passes. In an embodiment, a scraper is mounted onto the main body of the closure which scrapes the outlet at the opening or hole through which the fluid passes resulting in a removal of dried fluid residue or crust which may have accumulated on the dispenser outlet.

In an embodiment, the present invention also relates to an apparatus for dispensing viscous fluids, comprising a turntable rotatable around an axis of rotation, a plurality of containers containing the fluid to be dispensed and connected to the turntable in positions spaced about the circumference of the turntable, and a plurality of pumps associated with each container for dispensing fluid therefrom and attached to the turntable. The pumps each have connectors for releasably connecting a container to each pump.

In an embodiment, the present invention provides an apparatus which is characterized by a stationary actuator positioned at the circumference of the turntable and being movable to and from a first inoperative position disengaged from the turntable, a first operative position in engagement with one of the connectors in which the connector is connected to the respective container, and a second operative position, in which the connector is disengaged from the container and the container may be removed and exchanged for another container.

Due to this feature according to the invention, it is possible to use a single actuator for several containers. By rotating the turntable, the container to be exchanged is positioned in front of the actuator and by operating the actuator, it is brought into engagement with the connector and then moved to such position that the container can be removed and replaced.

It is preferred therein that the movement of the actuator to and from the inoperative position and the first and second operative positions is done by one continuous manipulation of an actuating element, such as a handle.

In this manner, the operator does not have to do anything special to operate the actuator in two different ways. One conceivable embodiment to accomplish this is to provide the connector with a toothed rack and the actuator with a toothed ring, and wherein the toothed ring and the actuating element are coupled through a transmission mechanism transmitting a substantially continuous movement of the actuating element into a consecutive translating and rotating movement of the toothed ring.

In a preferred embodiment according to the present invention, the connector includes a nipple which is insertable into an opening of the container, the nipple being slidable in longitudinal direction of a holder, the holder being provide with a slit extending in transverse direction of the holder in order to introduce and fix a flange of the container to the holder with said opening aligned with the nipple.

In this embodiment, the operator only has to slide the container with its flange out of the slit, and then another container into the slit of the holder in order to exchange the containers.

A further improvement according to the invention is that the pumps are provided on the side of the turntable opposite to the side where the connectors are positioned, the pumps extending substantially parallel to the turntable in radial direction.

By positioning the pumps on the other side than the connectors, the pumps do not interfere with the containers so that there is a maximum available space on the turntable enabling the use of large containers and thereby lengthening the time between exchanges of containers. Positioning the pumps parallel to the turntable allows for a compact structure of the apparatus.

It is favorable if the turntable is rotatably supported by a plurality of rollers engaging the turntable at its circumference and supporting it in radial and axial directions.

Supporting the turntable at its circumference avoids the necessity of a shaft in the center of the turntable which increases the maximum available space for the pumps. If one or more of the rollers is movable to and from the turntable, then the mounting and demounting of a turntable is facilitated.

According to a further aspect of the invention, the pumps each include a valve which is movable between a position in which the pump may suck fluid from the container into a dosing reservoir and a position in which the pump may dispense fluid from the dosing reservoir, the valve being operable by a central gripper which has an operating stroke, the ends of which being determined by sensors.

This embodiment simplifies the apparatus and ensures an accurate dispensing of fluid from the containers.

It is therefore an advantage of the present invention to provide an improved dispenser for dispensing fluids provided in flexible packages.

Another advantage of the present invention is that it provides a dispenser for dispensing fluids provided in flexible packages which enables empty flexible packages or partially empty flexible packages to be removed and replaced with full flexible packages without interrupting the operation of the dispenser pump.

Another advantage of the present invention is that it provides a dispenser for dispensing viscous fluid from flexible packages that limits the exposure of the fluid to ambient air.

Yet another advantage of the present invention is that it provides an improved dispensing station for dispensing viscous fluid from flexible packages.

Still another advantage of the present invention is that it provides an improved closure for an outlet of a dispenser of viscous fluid which removes dried fluid and residue from the outlet.

Yet another advantage of the present invention is that it provides an improved apparatus for dispensing a variety of viscus fluids contained in flexible packages.

And another object of the present invention is that it provides an improved rotary turntable-type apparatus for dispensing a variety of viscus fluids contained in flexible packages and with an improved configuration for replacing an empty package with a full package.

Other objects and advantages of the invention will become apparent upon reading the following detailed description and appended claims, and upon reference to the accompanying drawings.

BRIEF DESCRIPTION OF THE DRAWINGS

For a more complete understanding of the invention, reference should now be made to the embodiments illustrated in greater detail in the accompanying drawings and described below by way of an examples of the invention.

FIG. 20 is a side view, partially sectioned, of the operating means for the pumping arrangement of FIG. 19.

FIGS. 21, 22 and 23 are a side view, cross section and front view, respectively, of the actuator for actuating the connector in order to exchange containers.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
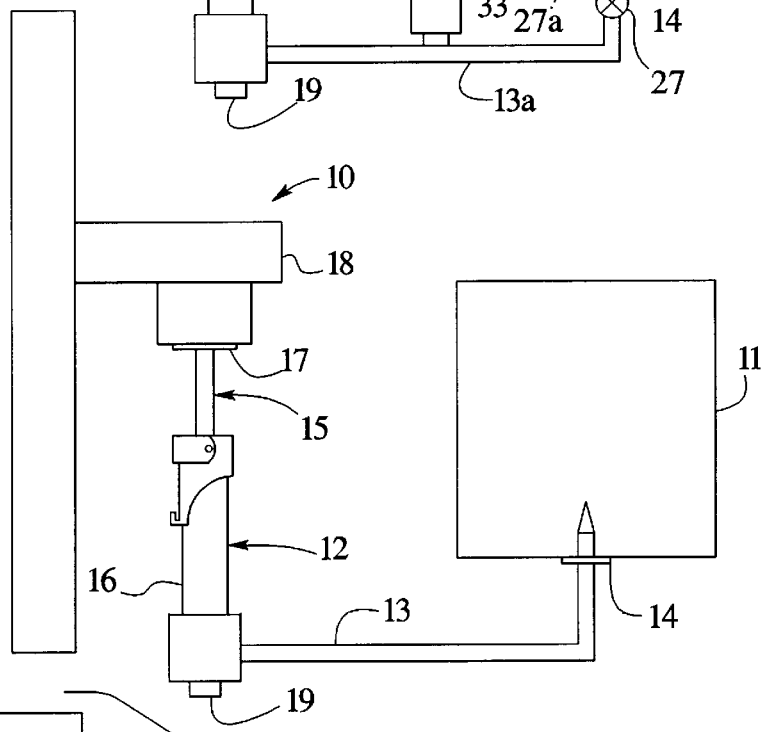
FIG. 1 is a partly schematic elevational view of a dispenser made in accordance with the present invention.

Turning first to FIG. 1, a dispenser 10 is illustrated which connects a flexible packaging or bag 11 that contains fluid to a piston-type pump 12. The conduit 13 connects the flexible package 11 to the pump 12. The conduit 13 is attached to the packaging 11 with a fitting 14 that makes it easy to connect and disconnect the package 11 from the conduit 13. The pump 12 includes a piston 15 having a lower end (not shown) disposed within the cylinder 16 and an upper end 17 that is detachably connected to an actuator arm 18 which moves the piston 15 upward during an intake stroke and downward during a discharge stroke. Fluid is discharged through the outlet 19.

In operation, a flexible package 11 is mounted onto the conduit 13 as shown in FIG. 1. The package 11 is full of viscous fluid to be dispensed through the outlet 19. The actuator arm 18 draws the piston 15 upward during an intake stroke which causes fluid to flow from the package 11, through the conduit 13 and into the cylinder 16. During a discharge stroke, the actuator arm 18 pushes the piston 15 downward causing the lower end (not shown) of the piston 15 to force fluid out of the cylinder 16 and through the outlet 19.

Figure 2:
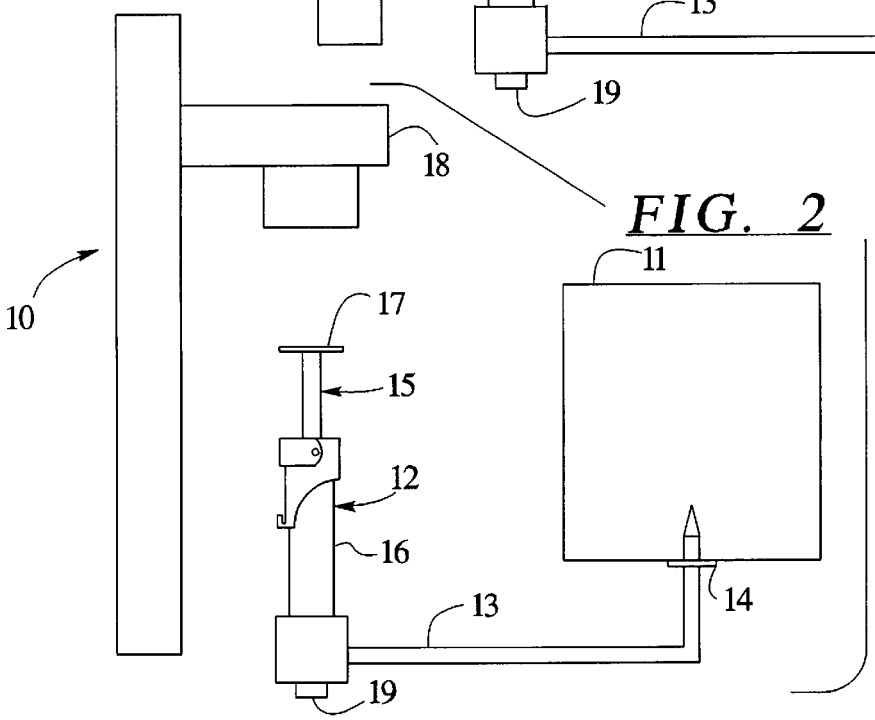
FIG. 2 is an elevational view of the dispenser first shown in FIG. 1 with the actuator detached from the piston of the pump.

In the event the package 11 becomes empty or nearly empty, the upward movement of the actuator arm 18 during an intake stroke results in the separation of the actuator arm 18 from the upper end 17 of the piston 15 as shown in FIG. 2. Specifically, when the package 11 is empty and an intake stroke is carried out, a low pressure or near vacuum environment is created in the cylinder 16, conduit 13 and package 11. This low pressure environment causes the piston 15 to be drawn downward into the cylinder 16 thereby resulting in separation between the upper end 17 of the piston 15 and the actuator arm 18 as shown in FIG. 2.

Figure 3:
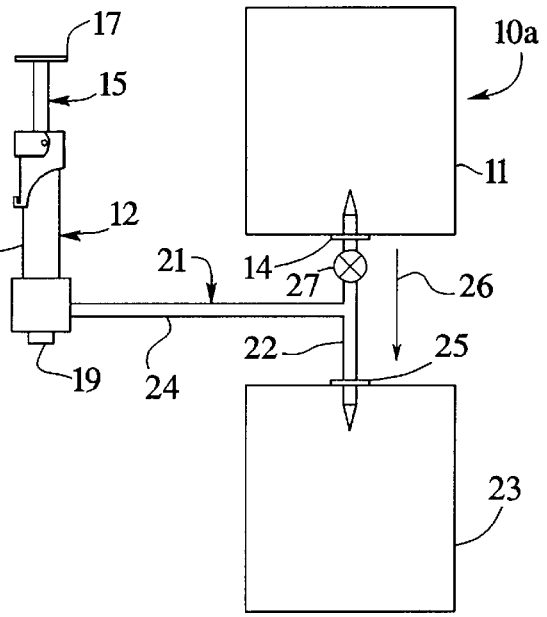
FIG. 3 is a partly schematic elevational view of another dispenser made in accordance with the present invention.

To alleviate the problem of the package 11 running out of fluid, a buffer may be provided as shown in FIG. 3. Specifically, a conduit 21 is provided that is T-shaped with a first section 22 connecting the package 11 with the package or buffer reservoir 23. A second section 24 connects the first section 22 to the pump 12. In the embodiment illustrated in FIG. 3, the buffer reservoir 23 is made of a material similar to the package 11 and is connected to the conduit section 22 with a fitting 25.

The operation of the dispenser 10*a* illustrated in FIG. 3 is as follows. Preferably, the buffer reservoir 23 is disposed vertically below the flexible package 11. This arrangement will allow fluid to flow under the force of gravity in the direction of the arrow 26 through the conduit section 22 and down into the buffer reservoir 23. During an intake stroke, fluid may flow from either the package 11 or the buffer reservoir 23, or both, through the conduit section 24 and into the cylinder 16. In the event all of the fluid has migrated from the package 11 to the buffer reservoir 23, only fluid from the reservoir 23 will travel through the conduit section 22 and conduit section 24 into the cylinder 16 during an intake stroke. When the package 11 is empty, the valve 27 disposed in the conduit section 22 may be closed thereby isolating the package 11. The package 11 may then be removed and replaced with a full package 11 without interrupting the operation of the pump 12. Accordingly, assuming the package 11 is replaced prior to the exhaustion of the fluid from the buffer reservoir 23, there will be no interruption in the operation of the dispenser 10*a* and the upper end 17 of the piston 15 will not become disengaged from the actuator arm 18 (not shown in FIG. 3; see FIGS. 1 and 2).

Figure 4:
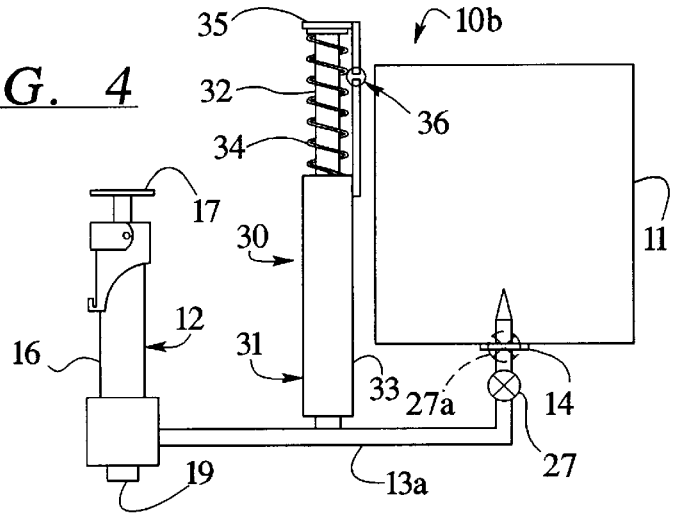
FIG. 4 is a partly schematic elevational view of another dispenser made in accordance with the present invention.

A different buffer system is illustrated in FIG. 4. Specifically, a flexible package 11 is connected to a pump 12 by way of a conduit 13*a* which differs from the conduit 13 shown in FIGS. 1 and 2 due to the placement of the valve 27 adjacent to the package 11 and the connection of the buffer system 30 between the package 11 and the pump 12. The buffer system 30 shown in FIG. 4 is an active buffer as opposed to the passive buffer reservoir 23 shown in FIG. 3. The buffer system 30 comprises a piston pump 31 which includes a piston 32, the lower end of which (not shown) is disposed inside a cylinder 33. A spring 34 is disposed between the cylinder 33 and the upper end 35 of the piston 32. The spring biases the piston 32 upward and the cylinder 33 is substantially full of fluid which is held in reserve until the package 11 becomes empty or near empty due to the biasing effect of the spring 34 on the piston 32. When the package 11 becomes empty, a low pressure environment is created in the cylinder 16 of the pump 12, the conduit 13*a* and the package 11. This low pressure environment causes fluid to be drawn out of the cylinder 33 and the suction effect eventually draws the piston 32 downward as the buffer system 30 now provides fluid to the pump 12 during an intake stroke of the pump 12. When fluid is being drawn from the buffer system 30, the valve 27 may be closed and the empty package 11 may be replaced with a full package 11. After replacement of the package 11, the valve may then be reopened to draw fluid from the package 11 into the conduit 13*a* during an intake stroke of the pump 12.

Preferably, a signal in the form of a contact switch 36 or other suitable signal is provided when the buffer system 30 of the dispenser 10*b* is activated. Then, the valve 27 may be closed automatically or manually and an operator may be notified that it is time to replace the package 11. Any suitable signal or alarm may be provided. Further, a signal or alarm may be provided for the passive buffer system shown in FIG. 3 which alerts an operator as to when fluid is being drawn only from the buffer reservoir 23 as opposed to the flexible package 11. Upon recognition of the alarm or signal, the operator will know that it is safe to close the valve 27 as shown in FIG. 3 and replace the flexible package 11 with a fresh package. A controller (not shown) may be used to notify the operator to change the main package 11. A software program may be employed to keep track of the amounts of viscous fluid dispensed. The software program may also alert the operator as to when the supply of fluid in the flexible package 11 and/or buffer reservoir 23 becomes depleted.

Figure 10:
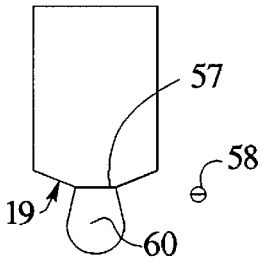
FIG. 10 is an elevational view of an outlet of a fluid dispenser equipped with a scraper.
Figure 11:
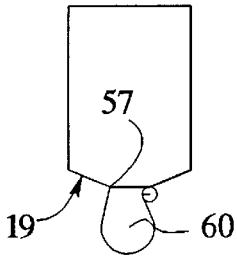
FIG. 11 is another elevational view of the outlet and scraper shown in FIG. 10 with the scraper shown engaging the outlet.
Figure 12:
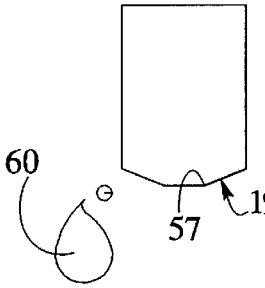
FIG. 12 is another elevational view of the outlet and scraper shown in FIG. 10 particularly illustrating the scraper just after it has engaged the outlet.
Figure 13:
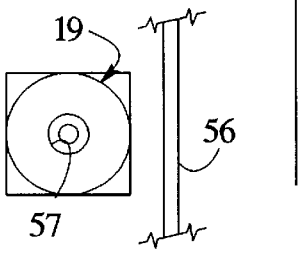
FIG. 13 is a bottom view of the outlet and scraper shown in FIG. 10.
Figure 14:
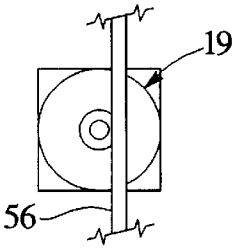
FIG. 14 is a bottom view of the outlet and scraper shown in FIG. 11.
Figure 15:
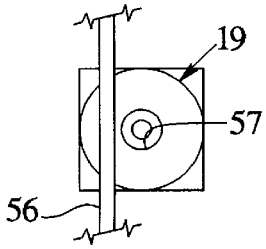
FIG. 15 is a bottom view of the outlet and scraper shown in FIG. 12.
Figure 5:
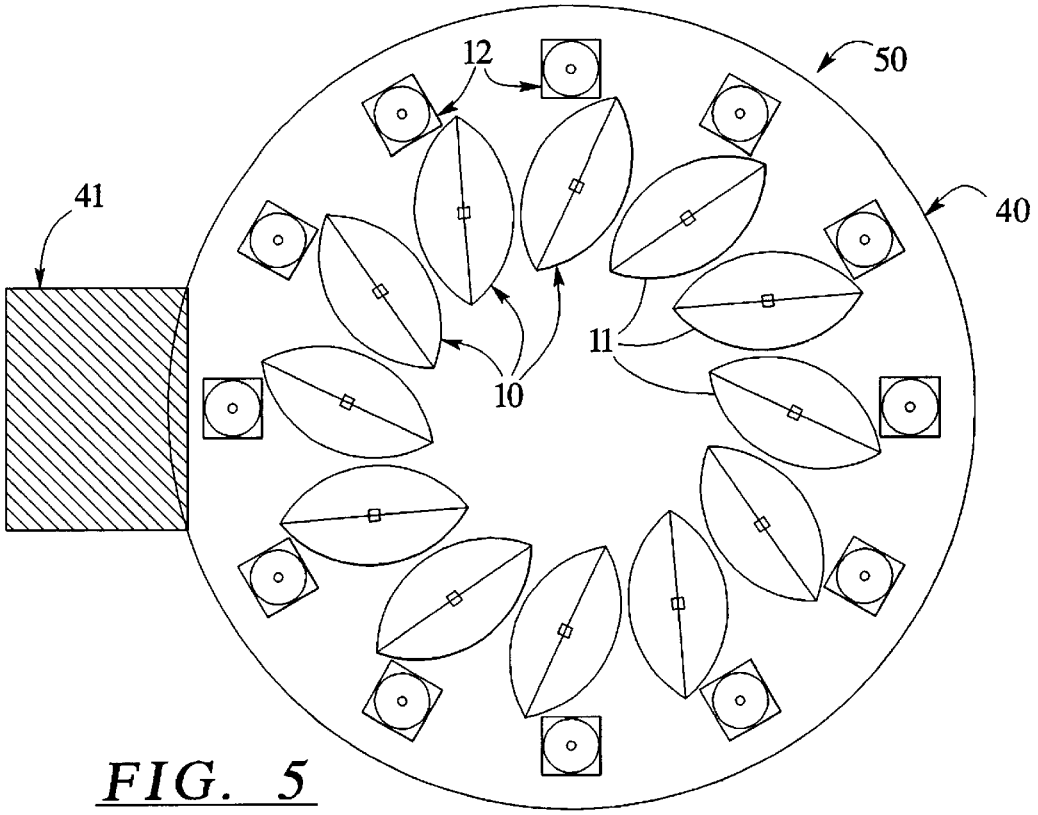
FIG. 5 is a plan view of a rotary dispensing station made in accordance with the present invention.
Figure 6:
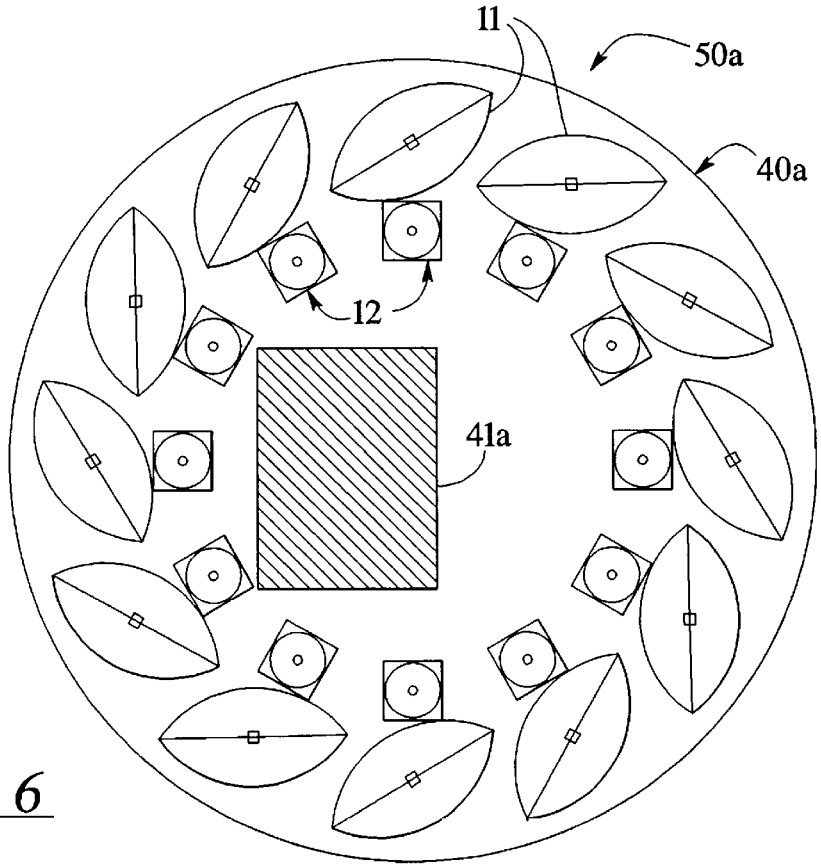
FIG. 6 is a plan view of another rotary dispensing station made in accordance with the present invention.
Figures 16, 16A:
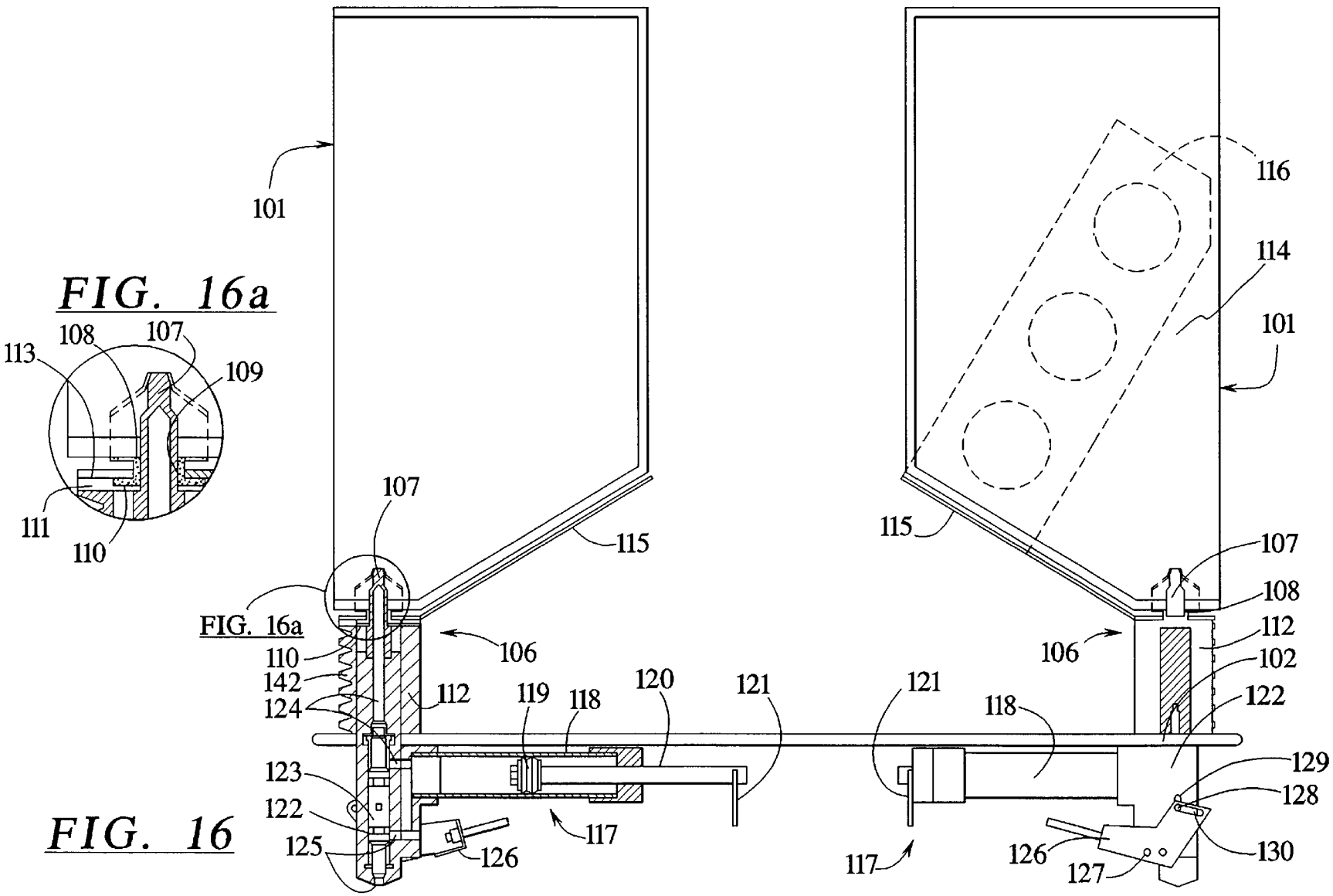
FIG. 16 is a side view, partially sectioned, of a turntable of the apparatus according to the invention, wherein several parts have been omitted.
FIG. 16*a* is an enlarged partial view of the apparatus shown in FIG. 16.
Figure 17:
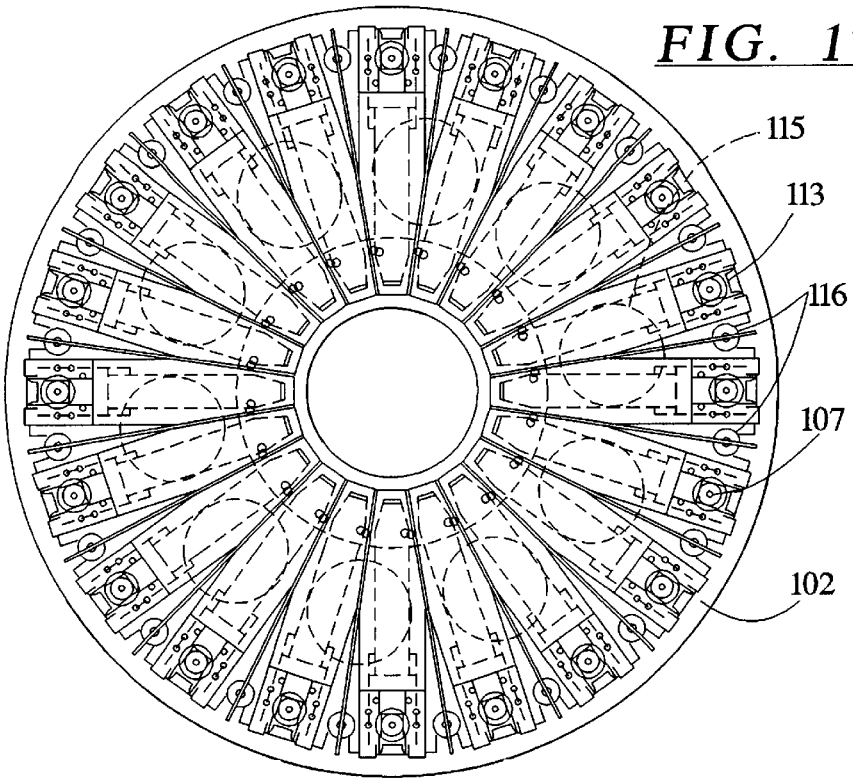
FIG. 17 is a top view of the turntable of FIG. 16 with all container supports shown.
Figure 18:
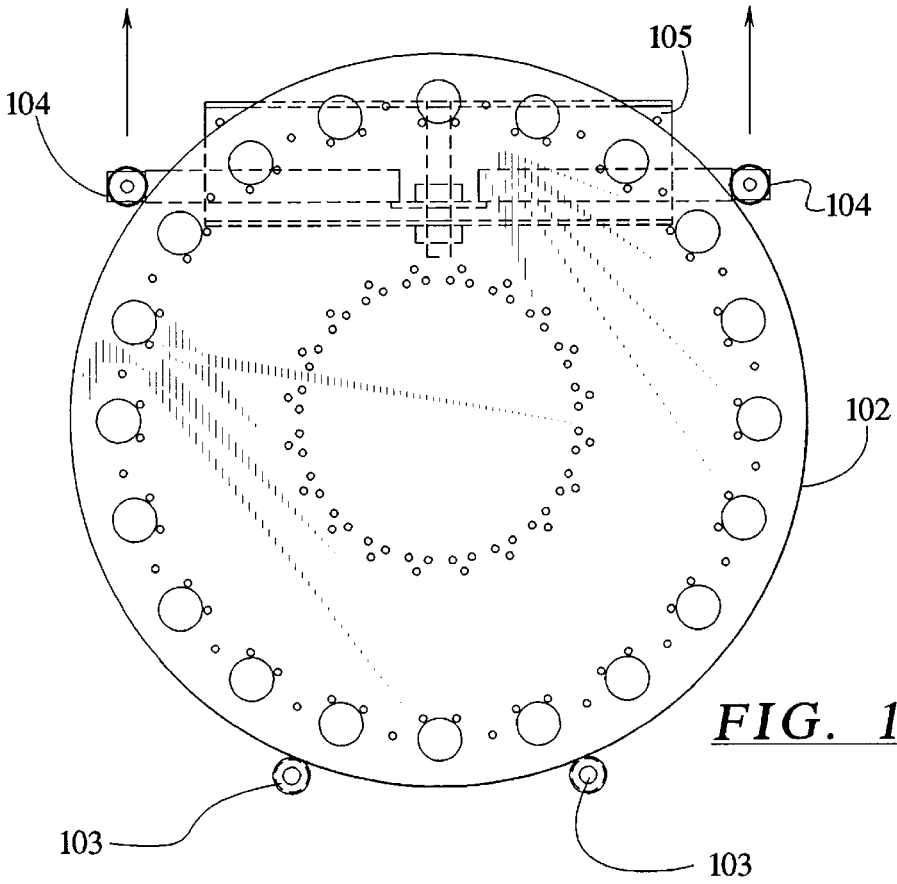
FIG. 18 is a larger scale top view of the turntable with only the support means for the turntable shown.

A plurality of dispense systems like those shown at 10 in FIGS. 1 and 2, 10*a* in FIG. 3 and 10*b* in FIG. 4 may be mounted onto a rotary table 40 as shown in FIG. 5. The table 40 may be rotated past a collection vessel 41 which can receive incremental amounts of fluid from any one of the dispensers 10 mounted to the table 40. The system 50 and 50*a* as shown in FIGS. 5 and 6 are particularly useful for those applications where small amounts of fluid are drawn from the packages 11 during the manufacture of a mixture, such as paint, ink or other colorant. The table may be rotated so that precise amounts of material may be drawn out from the packages 11 and added to the containment vessel 41 in an efficient method. With respect to the system 50*a* shown in FIG. 6, the containment vessel 41*a* may be disposed underneath a central portion of the table 40*a* as opposed to the outer periphery as shown in FIG. 5. The outlets for the dispensers 10 will typically be disposed below the rotary tables 40 and 40*a*.

Figure 7:
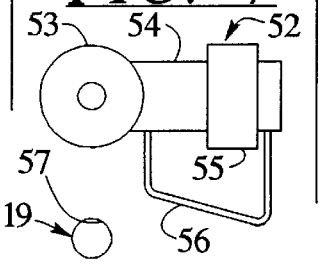
FIG. 7 is a bottom view of a closure for an outlet of a dispenser made in accordance with the present invention, particularly illustrating the closure in the open position.
Figure 8:
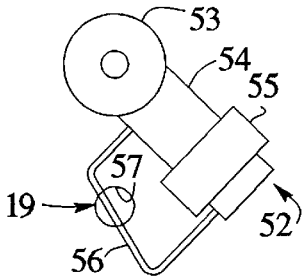
FIG. 8 is another bottom view of the closure first shown in FIG. 7 between the open and closed positions.
Figure 9:
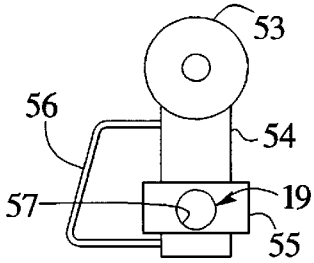
FIG. 9 is another bottom plan view of the closure first shown in FIG. 7 in the closed position.

Various configurations of the outlet 19 are shown in FIGS. 7 through 15. Referring to FIGS. 7–9, a closure 52 is attached to the pump 12 by way of a pivotal bracket 53. The closure 52 includes a main body 54 which accommodates a sealing ring 55 that is disposed over the outlet 19 as shown in FIG. 9 when the closure 52 is in the closed position. Mounted to the main body 54 is a scraper bar 56 which scrapes the outlet 19 and removes residue and dried fluid from the outlet 19 during each closure thereby keeping the outlet 19 in a clean, relatively residue free condition. As noted above, viscous fluids can dry and coat the outlet ultimately clogging the hole 57 through which the fluid passes.

Turning to FIGS. 10–15, a scraper 58 may be provided which pivots across the hole 57 in the outlet 19 through which the fluid 60 passes. Like the scraper 56 shown in FIGS. 7–9, the scraper 58 keeps the hole 57 and outlet 19 in a clean, relatively residue free condition and prevents clogging.

The buffer systems shown at 23 and 30 may be combined. Also, the buffer systems may be utilized in the rotary systems 50 and 50*a* shown in FIGS. 5–6. Further, the outlet closure configurations shown at 52 and 58 in FIGS. 7–15 may also be incorporated into any of the dispensers shown at 10 in FIGS. 1 and 2, 10*a* in FIG. 3 or 10*b* in FIG. 4. Still further, pumps other than the piston-type pumps 12 and 31 may be employed and the actuation system may be varied to include configurations other than the actuating arm shown at 18 in FIGS. 1 and 2. These and other alternatives are considered equivalents and within the spirit and scope of the present invention.

FIGS. 16–25 show an apparatus 100 for dispensing viscous fluids, such as hair dye contained in containers, in particular, flexible packages or bags 101. The apparatus is used to mix dosages from several packages 101 in order to create a hair dye of a particular recipe. In order to obtain an accurate mixture of hair dye from several containers, each containing a certain dye color, it is necessary that the apparatus is able to dispense the fluid in an accurate way.

The apparatus according to the invention comprises a horizontal turntable 102 rotatable about a vertical axis. The turntable 102 does not have a shaft in the center of the table, but is supported by support rollers 103, 104 (FIG. 18), the rollers 103 thereof being fixed and being only rotatable, whereas the rollers 104 are journaled on a slide which can be moved to and from the rollers 103. The object thereof is to engage the circumference of the turntable 102 in order to support it in axial and radial direction, or to disengage from the turntable 102 in order to release it for demounting purposes. In principal, it would also be possible to have only three rollers, one or two of which being movable.

In this case, the turntable 102 is adapted to contain twenty packages 101 spaced around the circumference of the turntable 102. For each package 101, there is provided a connector 106 having a nipple 107 adapted to frictionally engage into an opening of the package 101. For this purpose, the flexible package 101 has a rigid dispensing portion 108 through which a dispensing opening 109 extends and which may engage around the nipple 107. The dispensing portion 108 includes a flat flange 110 and its free end and this flange 110 may be inserted into a space 111 in a holder 112 of the connector 106. A slit 113 is provided to allow passage of the neck of the dispensing portion 108 of the package 101. It will be described later on now the nipple 107 and dispensing opening 109 of the package 101 are connected to each other. The dispensing portion 108 of the package 101 is connected to a storage portion 114 of the package 101. Such storage portion 114 is made of plastic foil and may be kept upright on the connector 106 by means of a bottom support 115 and side supports 116 of the connector 106. The side of the storage portion 114 of the flexible package 101 resting on the bottom support 115 and the opposite side of the package 101 is such that there are no dead spaces where fluid can be left as residue. During tests, a residue of maximally 1% remained within the package 101 after emptying it.

FIGS. 16, 19*a*–19*d* and 20 show a pumping arrangement 117 connected to each connector 106 and adapted to suck fluid from the respective package 101 and to press it out in order to dispense the fluid in an accurate dosage. The pumping arrangement 117 including a piston pump comprising a cylinder 118 as dosing reservoir and a piston 119 adapted to reciprocate within the cylinder 118 and being guided and controlled by a piston rod 120 carrying a driving lip 121 at its free end adapted to be engaged by a drive means to be described later on.

The cylinder 118 of the pumping arrangement 117 is connected to the nipple 107 of the connector 106 through a valve block 122. A pin shaped valve body 123 is slidably arranged within the valve block 122 and is slidable between a first position (FIGS. 19*a*, 19*b*) opening a suction channel 124 and closing a dispensing channel 125, and a second position (FIGS. 19*c*, 19*d*) in which the valve body 123 closes the suction channel 124 and opens the dispensing channel 125. The valve and channel arrangements are of conventional design.

The valve body 123 is operated by means of a control lever 126 which is pivotable around a horizontal pivot 127 and slidably engages with its forked end a pin 128 attached to the valve body 123 and extending through a vertical slot 129 in the valve block 122. The pin 128 engages in slots 130 on either side of the valve block 122 allowing movement between the control lever 126 and the pin 128 during vertical displacement of the pin 128 to move the valve body 123 to and from the first and second positions. The end of the control lever 126 remote from the pin slot connection 128, 130 can be engaged by a gripper 131 of an operating means which will be described hereafter (see FIG. 20).

FIG. 20 shows the operating means for the valve body 123 and pumping arrangement 117, the operating means including a linearly movable pump gripper 131 drivable by means of a drive spindle 132, and a rotatable valve gripper 133 which is rotatable around a horizontal pivot 134 and is driven by a crank mechanism 135. The crank shaft 136 of the crank mechanism 135 cooperates with a sensor 137 to determine the beginning and end of the stroke of the gripper 133. The beginning and end of the stroke of the crank mechanism 135 are near the top and bottom dead center of the crank mechanism 135 so that small variations in the start and end positions of the crank shaft have minimal effect on the start and end positions of the valve gripper 133.

The operation of the valve and pumping arrangements is as follows.

If the computer of the apparatus (not shown) has determined the dosage of a fluid to be dispensed from a particular package 101, the turntable is rotated by its drive means until the respective package 101 is positioned in line with the operating means. The grippers 131 and 133 thereof come into engagement with the driving lip 121 and the end of the control lever 126, respectively. The piston 119 and valve body 123 are in the positions according to FIG. 19*a*. Depending on the dosage to be dispensed, the piston 119 is displaced by the pump gripper 131 to the extent that the dosage to be dispensed is sucked into the cylinder 118 which serves as dosing reservoir.

Figure 19A:
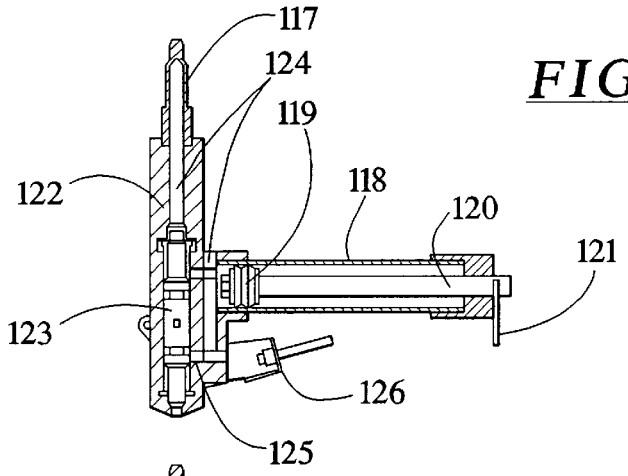
FIGS. 19*a*–19*d* are sectional views of the pumping arrangement of the apparatus in FIG. 16, shown in four different positions to illustrate the operation of the pump.
Figure 19B:
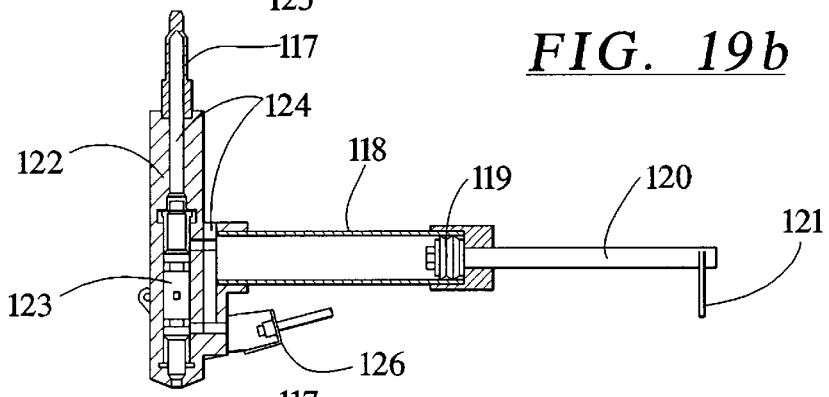
Figure 19C:
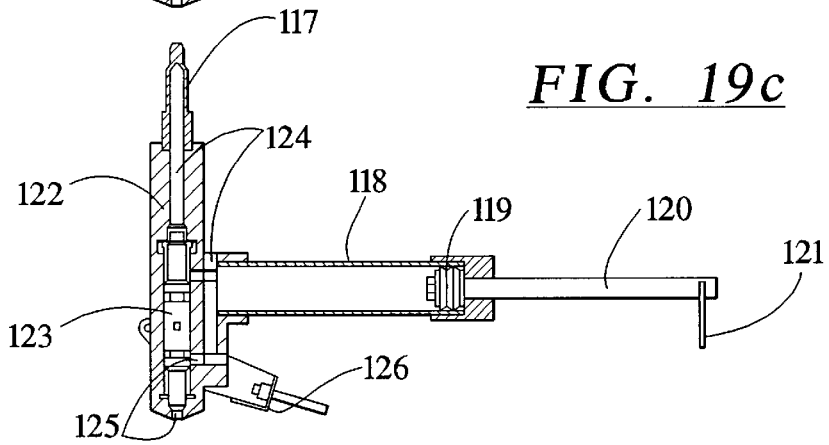
Figure 19D:
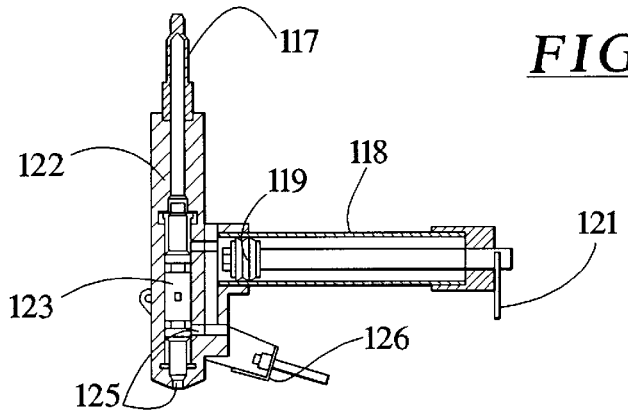

In FIG. 19*b*, the piston 119 has been moved to its maximally displaced position so that the whole cylinder has been filled with fluid. Then, the valve gripper 133 is rotated such that it moves the control lever 126 to the position according to FIG. 19*c* an hence, the valve body 123 is moved from its position allowing suction of fluid to its position allowing dispensing of fluid. It is shown that the valve body 123 closes the suction channel 124 and releases the dispensing channel 125. Thus, if the piston 119 is now moved to its original starting position, the fluid is dispensed through a lower dispensing opening of the valve arrangement, for example into a mixing container in which the hair dye colors from the various packages 101 are brought together and mixed.

The computer software accurately registers the original fluid content of a container and the fluid dosages dispensed so that it is known if a container is empty or almost empty. The computer signals to the operator when the contents of a package are not sufficient for a dosage to be dispensed and the apparatus may be arranged such that the operator may choose between exchanging the almost empty container for a new container 101 right away or using for a dosage a last portion of the almost empty package 101 together with a first portion of a new full package 101. If an empty package 101 should be removed, the nipple 107 of the connector 106 should be extracted from the dispensing opening 109 of the package 101 in order to allow the flange 110 of the dispensing portion 108 of the package 101 to be moved laterally from the space 111 in the connector 106. For this purpose, as shown in FIGS. 21–25, there is provided an actuator 138 including a handle 139 as actuating element and by manipulating this handle 139 the holder 112 will be engaged and will be displaced upwardly thereby displacing the package 101 and the dispensing portion 108 thereof upwardly with respect to the stationary nipple 107. As a result, the dispensing opening 109 and the nipple will become disengaged thereby enabling the dispensing portion 108 of the package 101 to be moved laterally without interference by the nipple 107. After a new package 101 has been positioned with its flange 110 in the space 111 of the holder 112, the handle 139 can be moved back and the new package 101 will be connected to this connector 106.

Since there is only one actuator 138 for all connectors 106 and packages 101, the turntable 102 should be able to move freely with respect to the actuator 138 in order to bring the package 101 to be exchanged in front of the actuator 138. For this purpose, the actuator 138 should e disengaged from the turntable during rotation of the turntable. When the connector 106 is positioned in front of the actuator 138, the actuator should be brought into engagement with the connector 106 and should be able to move it up and down. Thus, the actuator 138 should be able to perform different operations/movements and for this purpose there is provided a special transmission mechanism 140 converting a substantially continuous movement of the handle 139 into separate movements of its driving means, in this case consisting of a toothed ring 141 of the actuator 138 adapted to cooperate with a toothed rack provided on the outside of the holder 112 of the connector 106.

Figure 24:
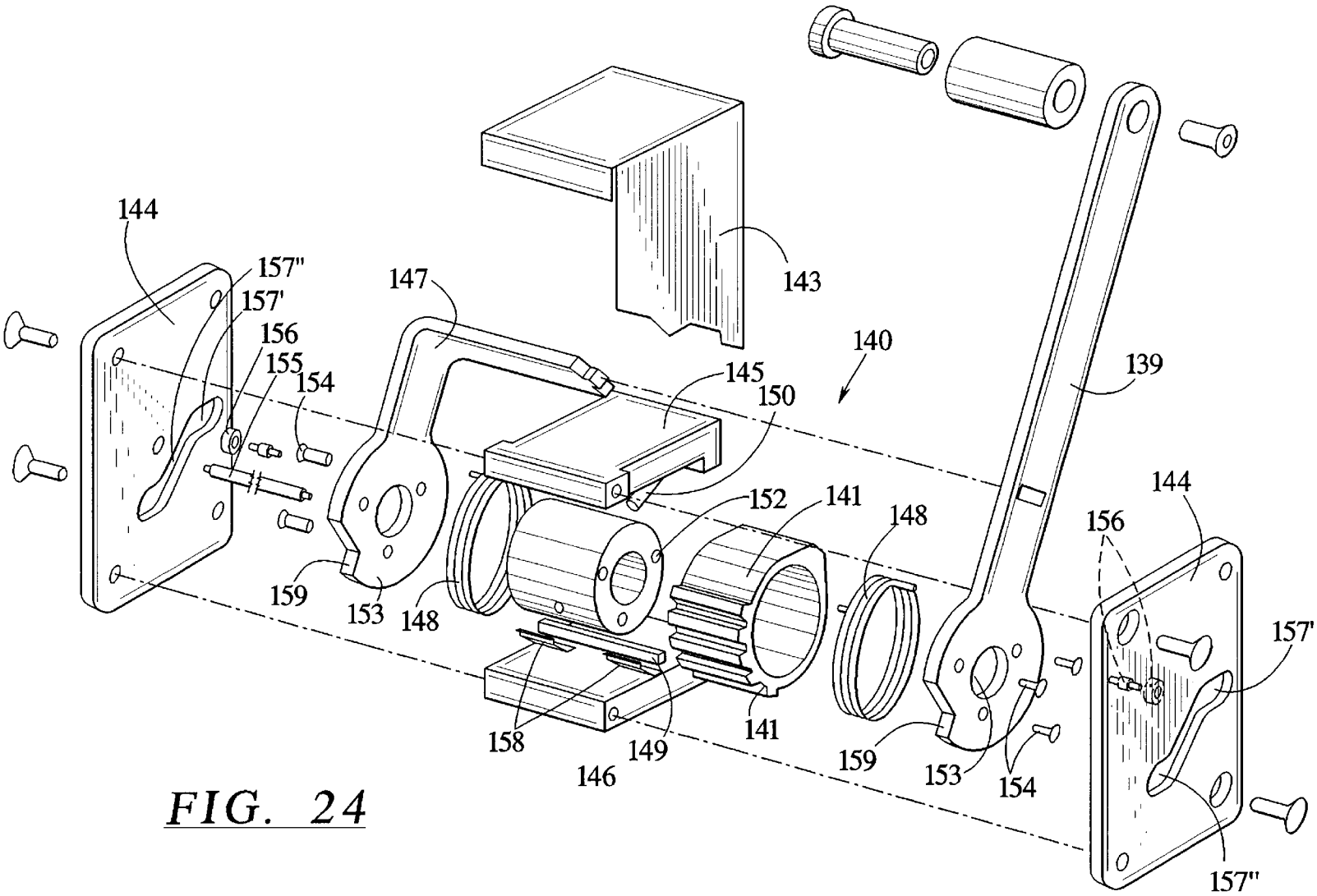
FIG. 24 is an explosive view of the actuator of FIGS. 21–23 on a larger scale.

FIGS. 21–23 illustrate the actuator 138, whereas the exploded view of FIG. 24 shows the various components thereof. The actuator 138 comprises a housing 143 including side plates 144 and upper and lower mounting plates 145 and 147. The handle 139 is fork-shaped on its lower side with an auxiliary part 147. The handle parts 139 and 147 are connected to the toothed ring 141 through torsion springs 148 the ends of which engage holes in the respective facing sides of the toothed ring 141 and the handle parts 139 and 147. The toothed ring 141 is mounted on a shaft 149 and is rotatable through a limited angle with respect to the shaft 149 which is determined by the engagement of a pin 150 protruding from the shaft 149 into a circumferential slot 151 extending circumferentially in the toothed ring 141 (see FIG. 22).

Both the shaft 149 and the handle parts 139 and 147 have a slotted hole 152, 153, respectively. The slotted holes 152 (FIG. 22), 153 (FIG. 24) extending axially are aligned with each other and are kept in relative position by fastening screws 154 fixing the handle 139 and the shaft 149 to each other. Extending through the slotted hole 152, 153 is an inner shaft 155 extending between the side plates 144 of the housing 143 and being supported thereby in a fixed manner. The handle 139,147 is also connected to the side plates 144 through a pin slot connection including a rotatable pin 156 and a curved slot 157 in the side plates 144. The rotatable pin 156 is attached to the handle 139, 147 excentrically spaced from the slotted hole 153 therein, whereas the curved slot 157 includes a first slot portion 157' extending substantially in a direction to the mounting hole for the inner shaft 155 and a second slot portion 157" extending concentrically around the mounting hole for the inner shaft 155.

The operation of the actuator 138 will be described with reference to the various positions of the actuator 138 as shown in FIG. 25.

Figures 25A, 25B, 25C, 25D, 25E:
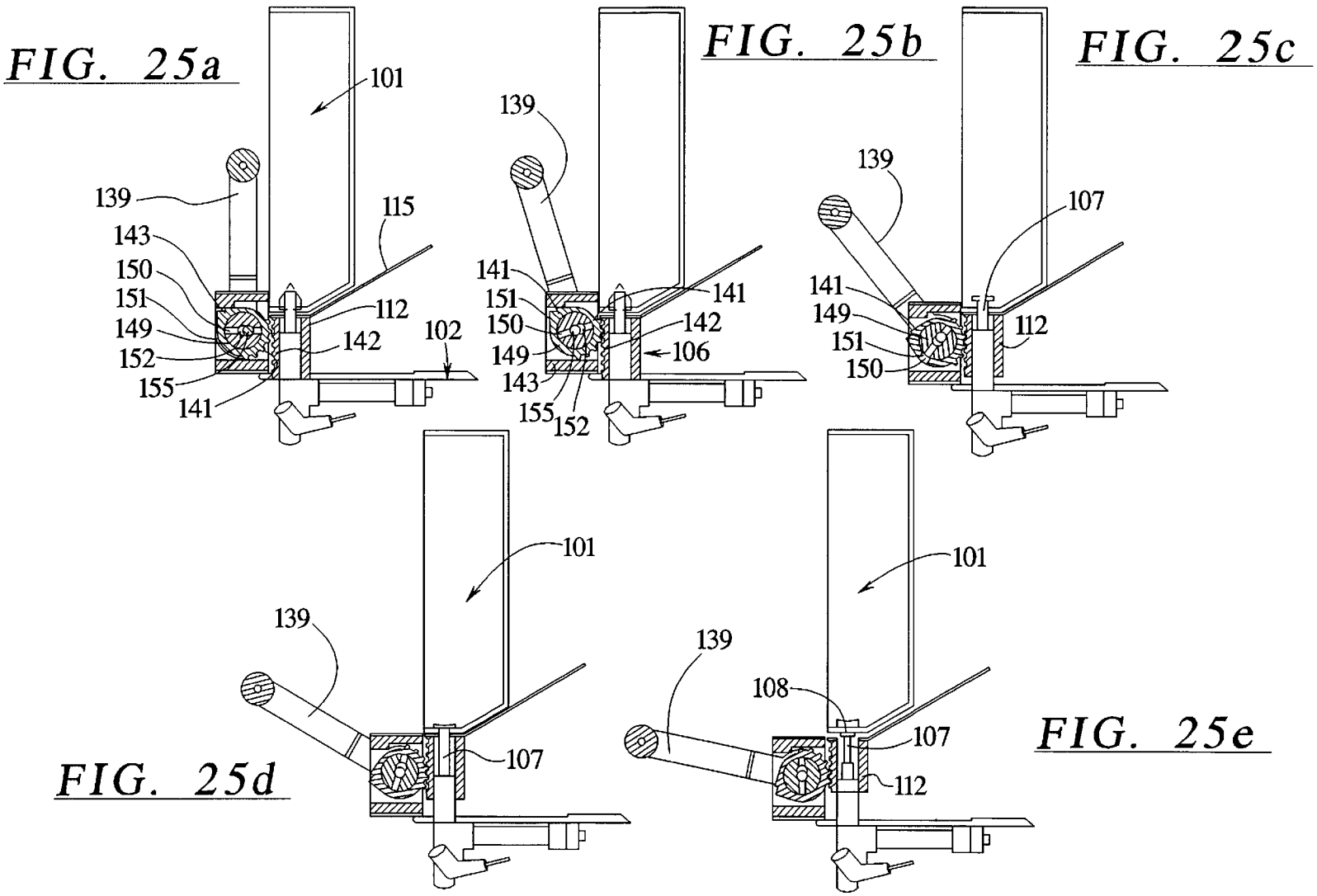
FIGS. 25*a*–25*e* are sectional views corresponding to FIG. 22 illustrating the operation of the actuator through five different positions.

In FIG. 25*a*, the actuator 138 is in the inoperative position with the handle 139 in an upright position. This position is maintained by leaf springs 158 attached on the lower mounting plate 146 of the housing 143 and engaging a recess 159 in the handle parts 139 and 147. The inner shaft 155 of the actuator 138 is at a first end of the horizontally extending slotted hole 152,153 facing the connector 106. In this position, the toothed ring 141 is disengaged from the toothed rack 142 on the holder 112. Thus, in this position the turntable is able to be rotated without interference with the actuator 138. In FIG. 25*a*, one connector 106 is positioned in front of the actuator 138.

When the handle is pulled away from the turntable 102 and the connector 106, a rotational force is exerted on the shaft 149 as well. However, the handle 139 is unable to rotate around the inner shaft 155 since the pins 156 of the handle parts 139, 147 engaging in the slot portion 157' of the curved slots 157 prevent such rotation. The only possible movement of the handle 139 is a forward movement in which the slotted hole 152, 153 is moved with respect to the inner shaft 155 and when the inner shaft 155 has arrived at the second end of the slotted hole 152,153 remote from the connector 106, the toothing of the toothed ring 141 has come into engagement with the toothing of the toothed rack 142 of the connector 106 and the pins 156 have left the slot portion 157' and have arrived in the concentric slot portion 157" of the curved slot 157, so that the pins 156 would now be able to perform a circular motion around the inner shaft 155.

In FIG. 25*b*, the handle 139, 147 is now able to rotate around the shaft 155 which is in the center of the handle and in the center of curvature of the slot portion 157". The handle 139, 147 will rotate relative to the toothed ring, thereby tensioning the torsion springs 148, until the pin 150 in the shaft 149 has reached the end wall of the slot 151 in the toothed ring 141. The protruding part of the toothed ring 141 facing away from the toothing is now released from the wall of the housing 43, so that the toothed ring is now able to follow the rotation of the handle 139, 147.

From the position of FIG. 25*b* to the position of FIG. 25*e*, the shaft 146 and, through the pin 150 engaging the end wall of the slot 151, the toothed ring 141 are rotated with the handle 139. Due to the engagement between the toothed rack 142 and the toothed ring 141, the connector 106 is moved upwardly to such an extend that the nipple 107 is disengaged from the dispensing opening 109 of the flexible package 101 so that this flexible package 101 which is empty may be removed and may be replaced by a full package. This is then engaged with its dispensing opening 109 over the nipple 107 by moving the handle 139 back to the position of FIG. 25*a*. Due to the engagement of the nipple 107 into the dispensing portion 108 of the package, it pushes away a self-closing valve of the package, so that the package opens and closed automatically upon displacement of the nipple into or out of the dispensing portion 108 of the package 101.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An apparatus for dispensing viscous fluids comprising:

a turntable rotatable around an axis of rotation;

the turntable being connected to a plurality of containers containing the fluid to be dispensed, the turntable comprising a circumference, the containers being spaced about the circumference of the turntable;

the turntable being connected to a plurality of pumps, each pump being releasably connected to one of the containers for dispensing fluid therefrom, the pumps comprising connectors for releasably connecting the containers to the pumps;

the apparatus further comprising a stationary actuator positioned at the circumference of the turntable and being movable to and from a first inoperative position wherein the actuator is disengaged from all of the connectors and a first operative position wherein the actuator is in engagement with one of the connectors and a second operative position wherein the actuator has disengaged said one of the connectors from its respective container and said respective container may be removed and exchanged for another container.

2. The apparatus of claim 1 wherein the actuator comprises an actuating element for moving the actuator between the inoperative position and the first and second operative positions.

3. The apparatus of claim 2 wherein the actuating element is a handle.

4. The apparatus of claim 2 wherein the connector comprises a toothed rack and the actuator comprises a toothed ring, the toothed ring an the toothed rack are coupled through a transmission mechanism transmitting a substantially continuous movement of the actuator into a consecutive translating and rotating movement of the toothed ring.

5. The apparatus of claim 4 wherein the transmission mechanism comprises a shaft fixed to a stationary support and the actuator comprises a slotted hole, the shaft extending through the toothed ring an the slotted hole having a length defined by a first end and a second end, wherein when the shaft is at a first end of the slotted hole, the toothed ring is out of engagement with the toothed rack of the connector and when the shaft is at the second en of the slotted hole the toothed ring is in engagement with the toothed rack of the connector, the toothed ring and the stationary support being further connected through a pin-slot connection, the slot of the pin-slot connection having at least two segments including a first segment dictating the translatory movement of the toothed ring and a second segment dictating the rotary movement of the toothed ring.

6. The apparatus of claim 5 wherein the actuating element and the toothed ring are rotatable with respect to each other to a limited extend and are connected by a torsion spring.

7. The apparatus of claim 1 wherein the connector comprises a nipple which is insertable into an opening of one of the containers, the nipple being slidably accommodated in a holder, the holder being provided with a slit extending in transverse direction of the holder, the containers each comprising a flange, the slit for receiving the flange of one of the containers.

8. The apparatus of claim 1 wherein the pumps and the connectors are disposed on opposing sides of the turntable.

9. The apparatus of claim 1 wherein the pumps extending substantially parallel to the turntable in a radial direction.

10. The apparatus of claim 1 wherein the turntable is rotatably supported by a plurality of rollers that engage the turntable at its circumference and supporting the turntable in the radial and axial directions.

11. The apparatus of claim 10 wherein the plurality of rollers comprises two positionally fixed rollers and at least one movable roller that is movable to and from the turntable.

12. The apparatus of claim 1 wherein the containers are flexible packages and the turntable comprises supporting means to hold the packages in an upright position.

13. The apparatus of claim 1 wherein the pumps each include a valve which is movable between a position in which the pump may suck fluid from the container into a dosing reservoir and a position in which the pump may dispense fluid from the dosing reservoir, the valve being operable by a central gripper which is movable through an operating stroke, the position of the central gripper being sensed by a plurality of sensors.

14. A container for use in the apparatus of claim 1 comprising a flexible storage part made from foil material and a rigid dispensing part including a dispensing opening, the dispensing part being attached to the storage part.

15. The container of claim 14 wherein the dispensing part further comprises a self-closing valve which is openable upon engagement with a nipple.

16. An apparatus for dispensing viscous fluids comprising:

a turntable rotatable around an axis of rotation;

the turntable being connected to a plurality of containers for containing the fluid to be dispensed, the turntable comprising a circumference, the containers being spaced about the circumference of the turntable;

the turntable further being connected to a plurality of pumps associated with each container for dispensing fluid therefrom, the pumps comprising connectors for releasably connecting the pumps to the containers, the pumps being disposed opposite the turntable from connectors, the pumps being disposed substantially parallel to the turntable and in a radial direction.

17. A container for use in the apparatus of claim 16 comprising a flexible storage part made from foil material and a rigid dispensing part including a dispensing opening, the dispensing part being attached to the storage part.

18. The apparatus of claim 16 wherein the turntable is rotatably supported by a plurality of rollers that engage the turntable at its circumference and supporting the turntable in the radial and axial directions.

19. An apparatus for dispensing viscous fluids comprising:

a turntable being connected to a plurality of containers for containing the fluid to be dispensed, the containers being spaced about the circumference of the turntable;

the turntable being connected to a plurality of pumps associated with each container for dispensing fluid therefrom, the pumps comprising connectors for releasably connecting the pumps to the containers;

the turntable being rotatably supported by a plurality of rollers that engage the turntable at its circumference and supporting the turntable in the radial and axial directions.

20. A container for use in the apparatus of claim 19 comprising a flexible storage part made from foil material and a rigid dispensing part including a dispensing opening, the dispensing part being attached to the storage part.

21. The apparatus of claim 20 wherein the pumps and the connectors are disposed on opposing sides of the turntable.

* * * * *